US005653621A

United States Patent [19]

Yao

[11] Patent Number: 5,653,621

[45] Date of Patent: Aug. 5, 1997

[54] TOY BUILDING BLOCK PUZZLE

[76] Inventor: Li-ho Yao, 4th Fl., No. 99-4, Tungan St., Taipei, Taiwan

[21] Appl. No.: 582,274

[22] Filed: Jan. 3, 1996

[51] Int. Cl.[6] ..... A63H 33/08

[52] U.S. Cl. ..... 446/127; 446/128; 446/85

[58] Field of Search ..... 446/127, 128, 446/125, 120, 121, 122, 123, 116, 85

[56] References Cited

U.S. PATENT DOCUMENTS

| | | | |
|---|---|---|---|
| 2,406,759 | 9/1946 | Glukes | 446/127 |
| 2,885,822 | 5/1959 | Onanian | 446/122 X |
| 3,252,287 | 5/1966 | Suzuki | 446/125 X |
| 3,583,091 | 6/1971 | Brockway | 446/121 |
| 5,267,863 | 12/1993 | Simmons, Jr. | 446/127 X |

FOREIGN PATENT DOCUMENTS

| | | | |
|---|---|---|---|
| 1273609 | 9/1961 | France | 446/121 |
| 8101581 | 10/1982 | Netherlands | 446/122 |
| 254273 | 12/1948 | Switzerland | 446/122 |
| 427207 | 6/1967 | Switzerland | 446/127 |
| 1544500 | 4/1979 | United Kingdom | 446/122 |

*Primary Examiner*—Robert A. Hafer
*Assistant Examiner*—D. Neal Muir

[57] ABSTRACT

A toy building block puzzle includes a first plurality of differently shaped tall hollow blocks which include lugs and slots on side walls thereof and protrusions and recesses on respective upper and lower sides thereof by which blocks of same or different shapes may be detachably interconnected to each other in vertical and horizontal planes. A second plurality of building elements comprises of adapters shaped as rods to increase permutations of interconnection between the blocks of the first group.

11 Claims, 4 Drawing Sheets

TOY BUILDING BLOCK PUZZLE

FIELD OF THE INVENTION

This invention relates to a toy building block puzzle comprising different shapes and sizes such as triangles and squares, which may have interlocking means on each face and further have a central bore extending therethrough. Furthermore, a variety of adapters are provided to increase permutations of interlocking ability between the blocks.

BACKGROUND OF THE INVENTION

The prior art toy building blocks have many sizes and shapes but substantially have interlocking means extending only from two opposite faces thereof which limits the possibilities of designs ultimately constructible with the blocks.

Furthermore, the simple interlocking means of prior art toy building blocks is usually a longitudinal press fit between protrusions of an upper face of a first block and corresponding recesses of a lower face in a second block. Such an interconnection is weak, particularly when subjected to a force perpendicular to a longitudinal force used to combine the blocks. Thus, a user may experience considerable frustration when, after having spent a lot of time constructing a model, e.g., an airplane, from the blocks, the model starts to disintegrate when played with as a toy.

Thus, it is found there is a long and unfulfilled need for a toy building element which has interlocking means provided on each face thereof and that interlocking means has a high resistance to impact yet can be simply overcome when desired.

SUMMARY OF THE INVENTION

One object of the present invention is to provide a set of toy building blocks which can be build either longitudinally or interconnected laterally.

Another object of the present invention is to provide a set of toy building blocks such that a structure constructed with the blocks cannot be separated by opposite lateral forces being applied respectively thereto and has considerable resistance to potentially destructive impact, yet can easily be disassembled when required.

In order to achieve the above objects, the present invention provides a toy building elements set wherein each element comprises a block, substantially hollow and having an open lower end, a closed upper end, a peripheral wall extending between the upper and lower ends, first interconnecting means disposed in the peripheral wall, second interconnecting means disposed in the upper end, third interconnecting means disposed in the lower end, and a passage extending between the upper and lower ends and within the peripheral wall whereby the elements can interlock with each other in a horizontal plane via the first interlocking means and a vertical plane via the second and the third interlocking means.

In accordance with one aspect of the present invention, the first interconnecting means comprises a plurality of 'C'-shaped lugs each having an arc greater than 180° extending perpendicularly and outwardly from a mediate point of the peripheral wall.

In accordance with another aspect of the present invention, the first interconnecting means comprises a plurality of 'C'-shaped slots inwardly defined in the peripheral wall.

The second interconnecting means comprises a plurality of cylindrical protrusions extending perpendicularly and upwardly from the upper end.

The third interconnecting means comprises a plurality of recesses sized, spaced and shaped to receive, and corresponding in plurality to the second interconnecting means.

The passage is defined by a tubular wall extending integrally from an inner face of the upper end to the lower end.

The peripheral wall comprises at least three side walls and each side wall is straight and of a length, identical to straight walls of other elements of a same size series.

In accordance with a further aspect of the present invention, the toy building elements further comprises a second plurality of elements each sized and configured to interlock with the first plurality of toy building elements to increase permutations of engagement therebetween.

Other objects, advantages, and novel features of the invention will become more apparent from the following detailed description when taken in accompaniment with the drawings.

DETAILED DESCRIPTION OF THE PREFERRED EMBODIMENTS

Figure 1:
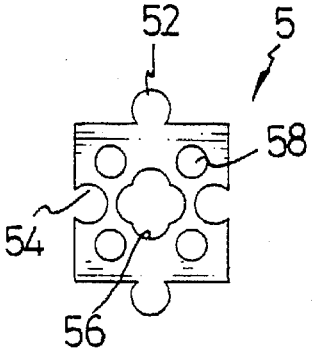
FIG. 1 is a top end view of a first element of the present invention.

Referring to the drawings, a toy building block puzzle includes at least a first group of different toy building elements (hereinafter the first group of elements are individually referred to as blocks) and a second group of elements preferably having three adapters. Each block of the first group is substantially hollow with an open bottom, a closed top wall, the top wall having a generally planar upper surface and a plurality of side walls extending downwardly from the top wall. Preferably, each block may have a plurality of 'C'-shaped lugs and 'C'-shaped slots which are sized and shaped to laterally and slidingly engage with each other when two blocks are mated. Each lug and slot is disposed at a mediate point of a respective sidewall and extends along a height thereof. Furthermore, each straight sidewall of a block has a same height and width as a respectively sized block although it may have a configuration different thereto. Each block has a plurality of protrusions extending integrally and upwardly from the top wall thereof and a corresponding plurality of recesses defined in the open bottom thereof, the protrusions and recesses sized and configured such that a top face of one block may be longitudinally engaged to a bottom of another block. The engagement is due to an interference fit between the recesses and protrusions which requires a predetermined force to engage and disengage two blocks.

Preferably, a block of a different size but of a same shape as another block may have protrusions and recesses of a size different to the other block.

Advantageously, when a block having at least four sidewalls has both lugs and slots, each lug and each slot is alternately disposed in respective sidewalls so that the lugs and slots alternate in sequence in a periphery of the block.

Figure 1A:
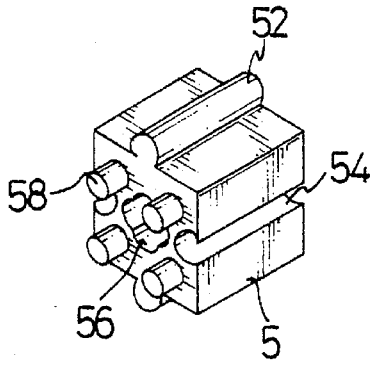
FIG. 1A is a perspective view of the first element shown in FIG. 1.

Referring to FIGS. 1 and 1A, a first block 5 is square in plan, having a top wall, an open bottom, four straight sides extending between the top wall and the bottom, two lugs 52, two slots 54, four projections 58, four recesses (not numbered) and a central passage 56 also extending between the top wall and the bottom and defined by a tubular portion.

Figure 2:
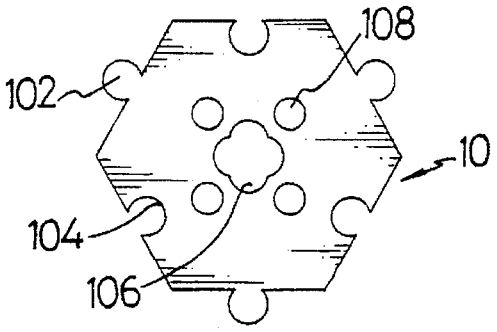
FIG. 2 is an end view of a second element of the present invention.
Figure 2A:
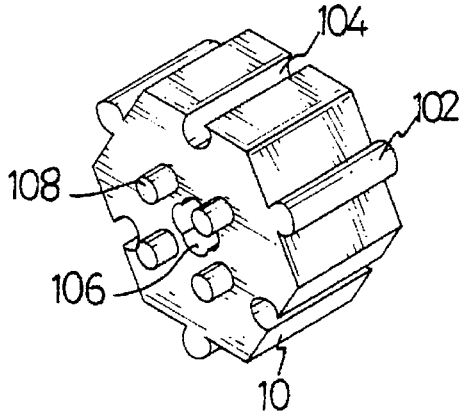
FIG. 2A is a perspective view of the second element shown in FIG. 2.

Referring to FIGS. 2 and 2A, a second block 10 is hexagonal in plan, having a top wall, an open bottom, six straight sides, three lugs 102, three slots 104, four upper projections 108, four lower recesses (not numbered) and a central passage 106 defined by a tubular portion extending between the top wall and the bottom.

Figure 3:
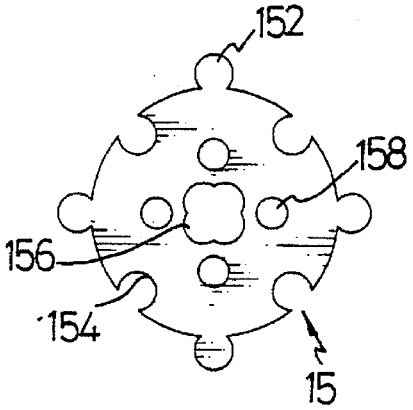
FIG. 3 is an end view of a third element of the present invention.
Figure 3A:
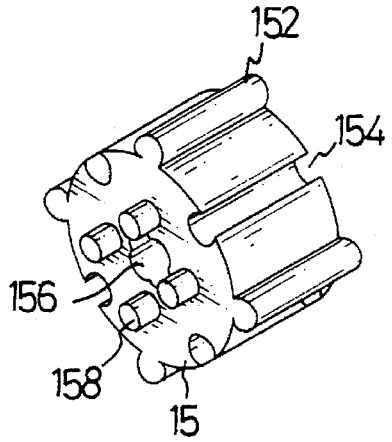
FIG. 3A is a perspective view of the third element shown in FIG. 1.

Referring to FIGS. 3 and 3A, a third block 15 is circular in plan, having a top wall, an open bottom, a circular side wall, four lugs 152, four slots 154, four upper projections 158, four lower recesses (not numbered) and a central passage 156 defined by a tubular portion extending integrally from the top wall to the bottom. Preferably, each lug and each slot are alternately and equidistantly disposed in the circular periphery.

Figure 4:
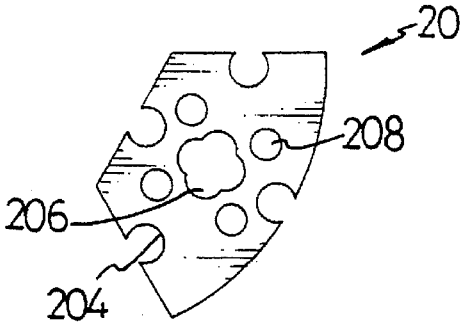
FIG. 4 is an end view of a fourth element of the present invention.
Figure 4A:
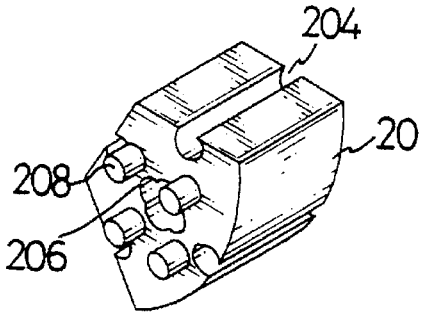
FIG. 4A is a perspective view of the fourth element shown in FIG. 4.

Referring to FIGS. 4 and 4A, a fourth block 20 has a plan which is a truncated sector of a circle having a top wall, an open bottom, three straight side walls and an arcuate side wall, four slots 204, four upper protrusions 208, four lower recess&s (not numbered) and a central passage 206 defined by a tubular portion extending integrally from the top wall to the bottom.

Figure 5:
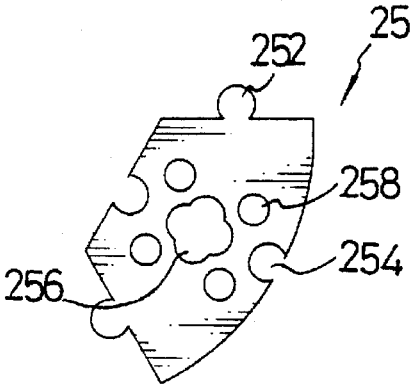
FIG. 5 is an end view of a fifth element of the present invention.
Figure 11:
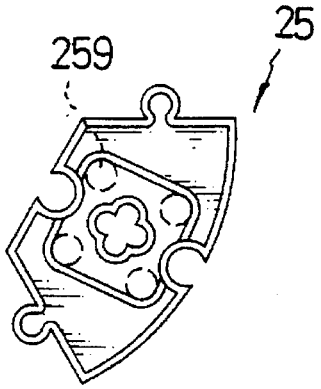
FIG. 11 is a second end view of the fifth element of the present invention.
Figure 5A:
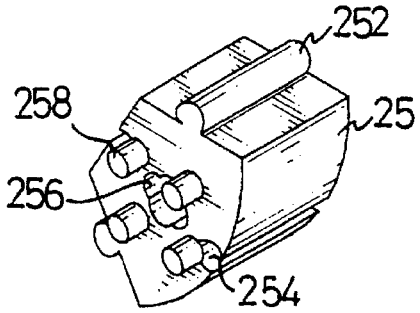
FIG. 5A is a perspective view of the fifth element shown in FIG. 5.

Referring to FIGS. 5, 5A and 11, a fifth block 25 has a plan which is a truncated sector of a circle having a top wall, an open bottom, three straight side walls and an arcuate side wall, two slots 254, two lugs 252, four upper protrusions 258, four lower recesses (not numbered) and a central passage 256 defined by a tubular portion extending integrally from the top wall to the bottom. Preferably, each recess is defined in the arcuate sidewall and a straight side wall opposite thereto and each lug is formed in the remaining two straight sidewalls.

Figure 6:
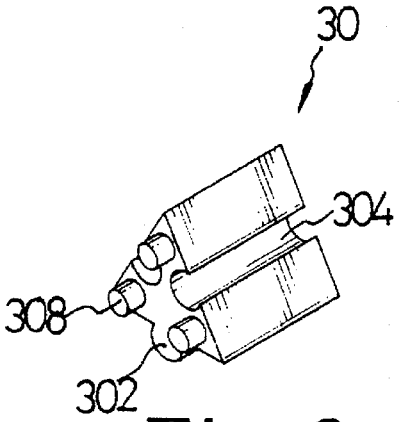
FIG. 6 is an isometric view of a sixth element of the present invention.

Referring to FIG. 6, a sixth block 30 is triangular in plan, having a top wall, an open bottom, three side walls, one lug 302, two slots 304, three upper projections 308, and three lower recesses (not numbered). Preferably, the triangular shape is an isoseles triangle.

Figure 7:
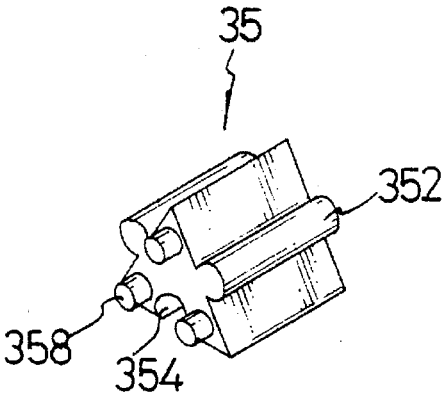
FIG. 7 is an isometric view of a seventh element of the present invention.

Referring to FIG. 7, a seventh block 35 is triangular in plan, having a top wall, an open bottom, three side walls, two lugs 352, one slot 354 three upper projections 358, and three lower recesses (not numbered). Preferably, the triangular shape is an isoseles triangle.

Figure 8:
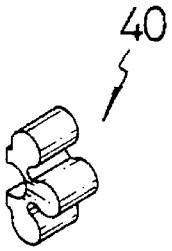
FIG. 8 is an isometric view of an eighth element of the present invention.

Referring to FIG. 8, a first adapter element 40 of the present invention is tri-lobic in plan wherein three lobes are preferably sized and configured to be each equal to a lug of the blocks and integrally formed in an arc to define a central slot sized and configured to receive a lug of a corresponding block.

Figure 9:
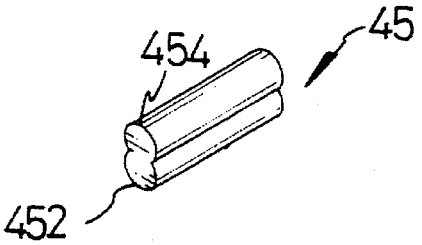
FIG. 9 is an isometric view of a ninth element of the present invention.

Referring to FIG. 9, a second adapter element 45 of the present invention includes a hollow rod, '8'-shaped in plan, thereby defining a first lug-like portion 452 integrally and longitudinally formed to a second lug-like portion 454, each lug-like portion being sized and configured to be receivable in a slot of a corresponding block.

Figure 10:
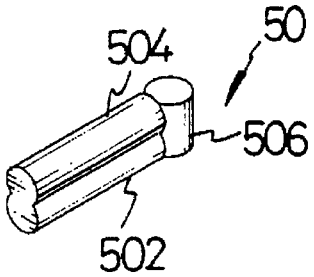
FIG. 10 is an isometric view of a tenth element of the present invention.

Referring to FIG. 10, a third adapter element 50 of the present invention is a hollow rod, '8'-shaped in plan, thereby defining a first lug-like portion 502 integrally and longitudinally formed to a second lug-like portion 504 with a third short lug-like portion 506 integrally and perpendicularly formed at one end of the first and second lug-like portions 502, 504. Each of the first, second and third lug-like portions 502, 504, 506 is sized and configured to be receivable in a slot of a corresponding block.

Furthermore, the blocks are preferably made of plastics material which is suitable for injection moulding.

It is to be further noted that building blocks of the present invention may have different heights yet still be engageable together.

Figure 12:
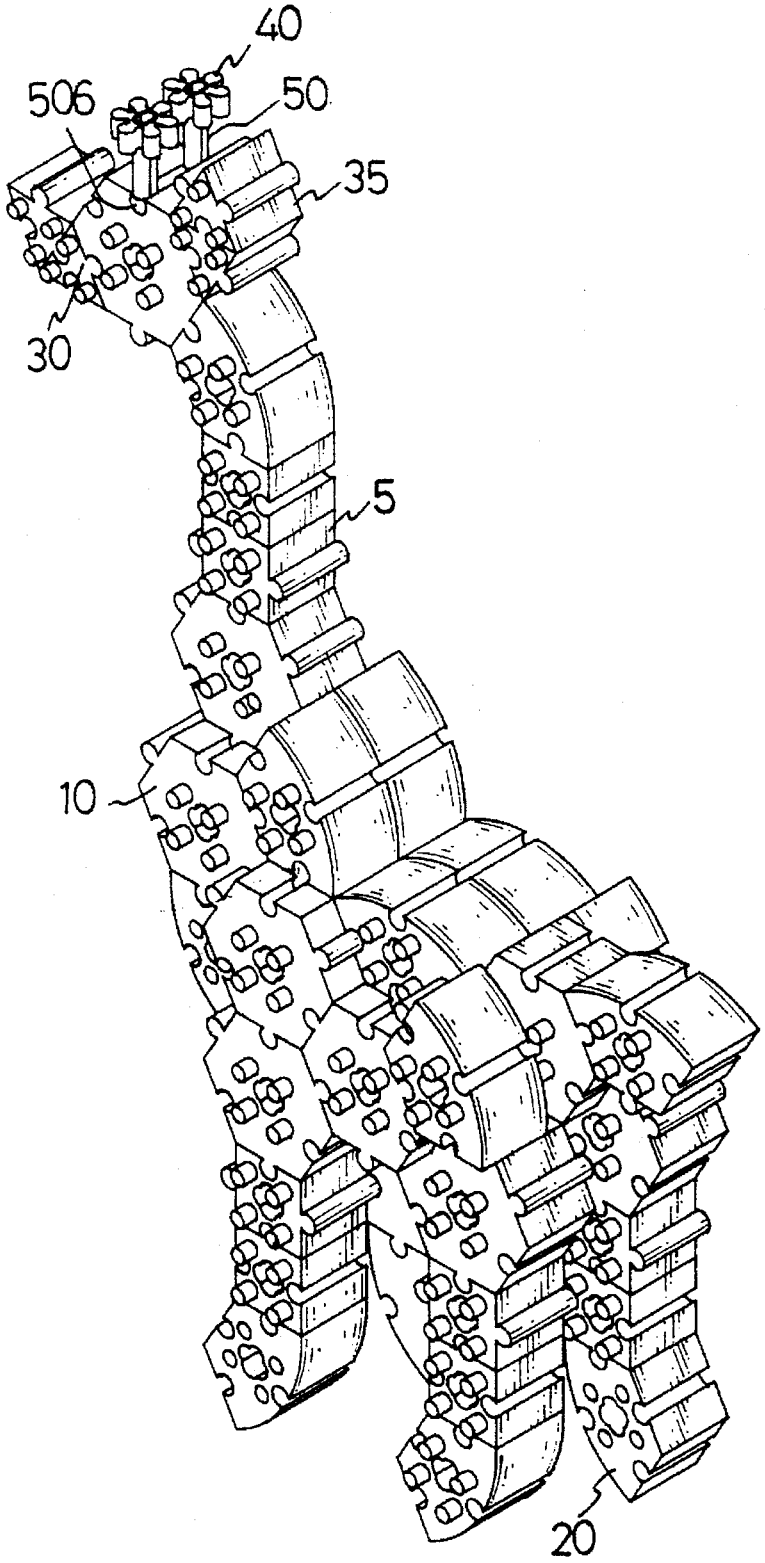
FIG. 12 shows an assembly example of building blocks and adapters in accordance with the present invention.

Building blocks and adapters of the present invention provide novelty in the construction of geometric and alphabetic shapes as shown in FIG. 12.

Although the present invention has been explained in relation to its preferred embodiments, it is to be understood that many other possible modifications and variations can be made without departing from the spirit and the scope of the invention as hereinafter claimed.

I claim:

1. A toy building elements set comprising:

a first element having a first plan shape, the first element having an upper end, a lower end, and connecting sidewalls therebetween;

a second element having a second plan shape, the second element having an upper end, a lower end, and connecting sidewalls therebetween;

a third element having a third plan shape, the third element having an upper end, a lower end, and connecting sidewalls therebetween;

the first, second, and third elements each having a first means for interconnecting formed on the individual sidewalls thereof, a second interconnecting means formed on the individual upper ends thereof and a third interconnecting means formed on the individual lower ends thereof;

the first interconnecting means comprising a plurality of matably engaging "C" shaped lugs and slots;

the second interconnecting means comprising a plurality of cylindrical protrusions extending perpendicularly and upwardly from the upper end; and the third interconnecting means comprising the lower end having a plurality of recesses, said recesses spaced and shaped to receive the cylindrical protrusions.

2. A toy building elements set comprising:

a first element substantially square in plan shape having an upper end, a lower end, and connecting sidewalls therebetween;

a second element substantially hexagonal in plan shape having an upper end, a lower end, and connecting sidewalls therebetween;

a third element substantially circular in plan shape having an upper end, a lower end, and a connecting sidewall therebetween;

a fourth element substantially truncated-sectored in plan shape having an upper end, a lower end, and connecting sidewalls therebetween;

a fifth element substantially truncated-sectored in plan shape having an upper end, a lower end, and connecting sidewalls therebetween;

a sixth element substantially triangular in plan shape having an upper end, a lower end, and connecting sidewalls therebetween;

the first, second, third, fourth, fifth and sixth elements each having a first means for interconnecting formed on the individual sidewalls thereof, a second interconnecting means formed on the individual upper ends thereof and a third interconnecting means formed on the individual lower ends thereof;

the first interconnecting means comprising a plurality of matably engaging "C" shaped lugs and slots;

the second interconnecting means comprising a plurality of cylindrical protrusions extending perpendicularly and upwardly from the upper end;

the third interconnecting means comprising the lower end having a plurality of recesses, said recesses spaced and shaped to receive the cylindrical protrusions.

3. The toy building elements set as claimed in claim 2, further comprising a first adapter comprised of two integrally formed longitudinal lugs being '8'-shaped in cross-section, the lugs are dimensioned and spaced such that when the adapter is matably engaged with two slots of two elements, the elements are placed in close proximity.

4. The toy building elements set as claimed in claim 2, further comprising a second adapter comprised of two integrally formed longitudinal lugs being '8'-shaped in cross-section and a lug integrally and perpendicularly disposed at an end of the two longitudinal lugs.

5. The toy building elements set as claimed in claim 2, further comprising a third adapter having three lugs in a radially spaced apart relationship about a center point, the third adapter having a slot at the center point.

6. The toy building elements set as claimed in claim 2, wherein:

the first element comprises a first, second, third, and fourth sidewall;

the first interconnecting means of the first element comprises the first and third sidewalls each having a lug disposed thereon, the second and fourth sidewall each having a slot disposed therein.

7. The toy building elements set as claimed in claim 2, wherein:

the second element comprises a first, second, third, fourth, fifth, and sixth sidewall;

the first interconnecting means of the second element comprises the first, third, and fifth sidewalls having a lug disposed thereon, the second, fourth, and sixth sidewall having a slot disposed therein.

8. The toy building elements set as claimed in claim 2, wherein:

the first interconnecting means of the third element comprises four lugs in an equally spaced apart relationship disposed on the sidewall, and the sidewall having four slots therein, each slot spaced equally between two lugs.

9. The toy building elements set as claimed in claim 2, wherein:

the fourth element comprises four sidewalls, said sidewalls comprise three flat sidewalls and a curved sidewall; and the first interconnecting means of the fourth element comprises each of the four sidewalls having a slot disposed therein.

10. The toy building elements set as claimed in claim 2, wherein:

the fifth element comprises four sidewalls, said sidewalls comprise three flat sidewalls and a curved sidewall;

the first interconnecting means of the fourth element comprises two of the three flat sidewalls having a lug disposed thereon, the flat sidewall opposite said curved sidewall having a slot therein, and the curved sidewall having a slot disposed therein.

11. The toy building elements set as claimed in claim 2, wherein the first, second, third, fourth and fifth elements each having a passage centrally disposed therethrough.

* * * * *